United States Patent [19]

Craig, Jr.

[11] Patent Number: 4,748,058

[45] Date of Patent: May 31, 1988

[54] ARTIFICIAL TREE

[76] Inventor: Chester L. Craig, Jr., Rt. 1, Box 303, Somerton, Ariz. 85350

[21] Appl. No.: 13,056

[22] Filed: Feb. 10, 1987

[51] Int. Cl.[4] ..... A47G 33/06

[52] U.S. Cl. ..... 428/9; D11/118; 428/18

[58] Field of Search ..... D11/118; 362/123; 428/9, 18, 19, 20

[56] References Cited

U.S. PATENT DOCUMENTS

| | | | |
|---|---|---|---|
| D. 236,216 | 8/1975 | Fred | 428/18 X |
| D. 256,223 | 8/1980 | Byun | D11/118 |
| 835,445 | 11/1906 | Leonard | 428/19 X |
| 2,732,646 | 1/1956 | James | 428/20 |
| 2,826,846 | 3/1958 | Warren | 428/20 X |
| 2,841,901 | 7/1958 | Maple | D11/118 X |
| 2,864,192 | 12/1958 | Shoalts | 428/18 X |
| 2,876,339 | 3/1959 | Thorne | 428/18 X |
| 3,020,660 | 2/1962 | Scherotto | 428/18 X |
| 3,677,867 | 7/1972 | Westlund | 428/20 X |
| 3,834,976 | 9/1974 | Mottel | 428/18 |
| 3,839,131 | 10/1974 | Christiansen, Jr. | 428/18 |
| 4,054,696 | 10/1977 | Crownover | 428/9 |
| 4,130,678 | 12/1978 | Higgins | 428/20 X |
| 4,331,720 | 5/1982 | Vin Dick et al. | 428/20 X |
| 4,451,510 | 5/1984 | Boisvert et al. | 428/20 X |

*Primary Examiner*—Henry F. Epstein

*Attorney, Agent, or Firm*—Larson & Taylor

[57] ABSTRACT

An artificial tree assembly, and a tree constructed therefrom, are provided. The assembly comprises a collapsible three-piece pole; a base member formed by the bottom of a box for storing the tree assembly and including a pole support member secured thereto for supporting the pole; and a plurality of limb sections and interconnecting garlands. The limb-sections each comprise a central ring portion and a plurality of limb members extending radially outwardly from the central ring portions. The ring portions of the limb sections are stacked, when not in use, on the pole support member and are disposed, in use, along the length of pole in spaced relationship therealong. The garlands interconnect the limb portions so that as the ring portions are lifted, from the top, from the stacked positions thereof on the pole support member and slid along the pole, the garlands between adjacent limb section are tensioned, in turn, and thus serve to lift the next adjacent limb section until the tree is fully erected.

20 Claims, 3 Drawing Sheets

FIG. 3
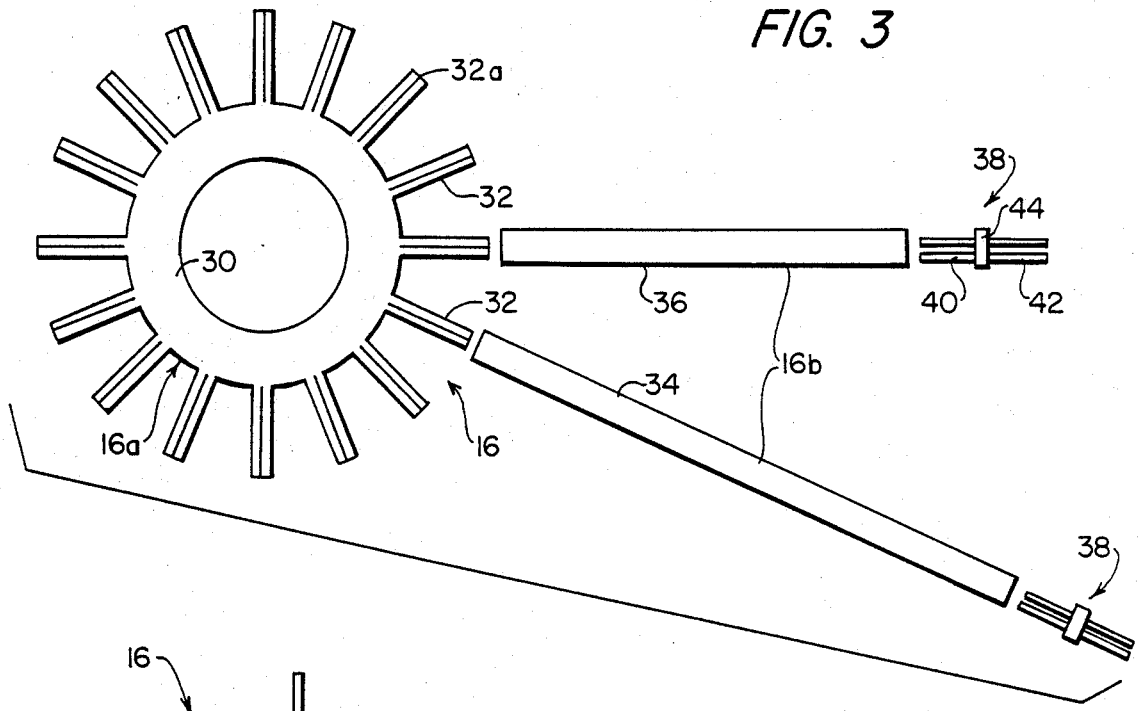
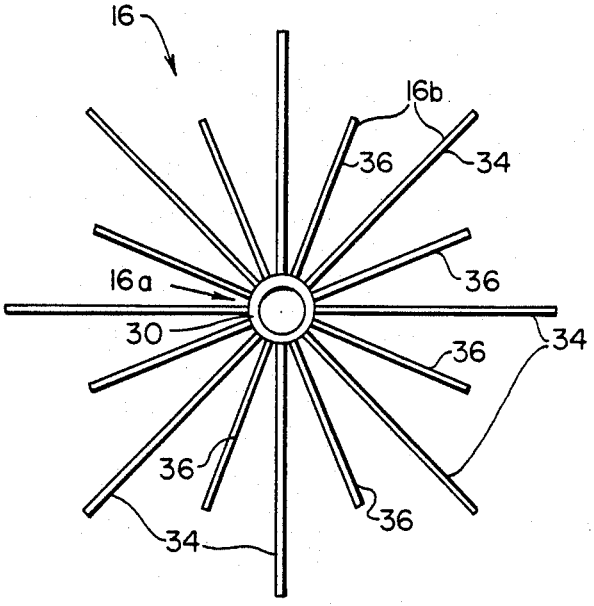
FIG. 6
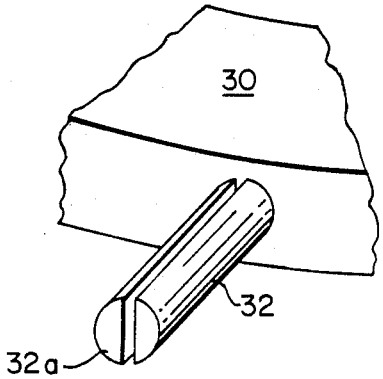
FIG. 4
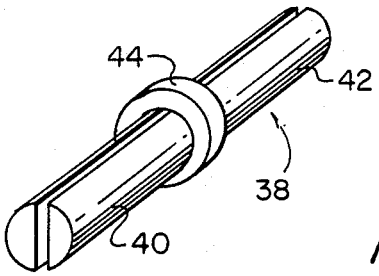
FIG. 5

ARTIFICIAL TREE

FIELD OF THE INVENTION

The present invention relates to artificial trees such as used as Christmas trees.

BACKGROUND OF THE INVENTION

Artificial Christmas trees are very common and many different approaches have been taken in constructing such trees. A number of patents have granted on artificial trees and these include: U.S. Pat. Nos. 3,677,867 (Westlund); 4,331,720 (Vin Dick et al); 4,130,678 (Higgins); 3,839,131 (Christiansen); 3,020,660 (Scherotto); 2,864,192 (Shoalts); D. 236,216 (Fred); 2,732,646 (James); 4,054,696 (Crownover); D. 256,223 (Byun) and 835,445 (Leonard).

Briefly considering these patents, the Westlund patent discloses a collapsible artificial Christmas tree which fits into a relatively flat box and, in one embodiment, includes a support stand. The tree is formed by a garland with interconnecting members. The Vin Dick et al patent discloses a Christmas tree which folds away into a relatively thin box, the box serving as a stand for the tree when the tree is erected. A conical structure resembling a tree is supported by the stand. The Higgins patent discloses a collapsible artifical Christmas tree including a telescopic mast mounted on a base and a garland extending between the base and the top of the mast. The Christiansen patent discloses a simulated Christmas tree defined by a plurality of concentric hollow truncated cones of progessively diminishing size. The Scherotto patent discloses a collapsible imitation tree which when erected takes one of two forms. The Shoalts patent discloses a simulated Christmas tree including a support framework. The Fred patent discloses a mobile Christmas tree including garlands extending between a base and the top of a mast. The James patent discloses a knock-down type Christmas tree structure made from components which are initially flat. The Crownover patent discloses an artificial tree including a central pole member and a plurality of vertically extending accordion-type limb sections. The Byun patent discloses a collapsible artificial Christmas tree formed from sections of increasingly large size and supported from a central mast. Finally, the Leonard patent discloses an artifical tree including a support framework.

SUMMARY OF THE INVENTION

In accordance with the present invention, an artificial tree assembly is provided which pulls up to a full tree from a flat, pizza-style box. The bottom of the box forms the base of the tree and the nature assembly of the is such that as the tip of a limb and garland arrangement (comprised by limb-forming support members and interconnecting garlands, is lifted upwardly along a central support pole, the garlands are tensioned so that the uppermost limb section is lifted up, thereby causing tensioning of the garlands connected to the next limb section and thus providing lifting of that section. This process continues as the lifting continues and by affixing the tip of the arrangement to the top of the central support pole the entire limb and garland arrangement can be suspended from the pole. This assembly enables the tree to be erected in less than about one minute and to be disassembled and stored in the box in less than about thirty seconds.

Thus, in accordance with one aspect of the invention, an artificial tree assembly is provided which comprises a collapsible pole; a base member formed by the bottom of a box for the storing the tree assembly and including a pole support member secured thereto for supporting the pole; a plurality of limb sections wherein each of the limb sections comprises a central ring portion and a plurality of limb members extending radially outwardly from the central ring portions and wherein the ring portions of the limb sections are stacked, when not in use, on the pole support member and are disposed, in use, along the length of the pole in spaced relationship therealong; and a plurality of garlands interconnecting the limb portions so that as the ring portions are lifted from the top from the stacked position thereof on the pole support member and slid along the pole, the garlands between adjacent limb sections are tensioned in turn and thereby serve to lift the next adjacent limb section until all of the rings assume the aforesaid spaced relationship along the pole whereby the tree is thus fully erected.

The collapsible pole preferably comprises a plurality of separate pole parts which can be fit together to form the pole. Advantageously, the support member includes a tubular end portion in which the pole is received. The limb members are of different lengths, and preferably the limb members of different limb setions are of different lengths, the lengths of the limb members becoming gradually shorter as a function of the spacing from the base member so that the lengths of limb members conform to the shape of a fir tree. Advantageously, the limb members of the same limb section are also of two different lengths. Further, some of the garlands preferably extend between, and interconnect, three different limb sections in such a way as to provide shaping of the tree.

In an advantageous embodiment, the ring portions each comprise a ring including a plurality of slotted projections in which associated garlands are received, and the limb members comprise elongate tubes received at one end on said projections. Preferably, the limb members further comprise slotted connectors which are received in the other ends of the tubes, and in which associated garlands are received.

As discussed below, the invention also relates to a tree construction produced from an assembly such as described above.

It will be understood that other features and advantages of the invention will be set forth, or apparent from, the detailed description of a preferred embodiment which follows.

BRIEF DESCRIPTION OF THE DRAWINGS

FIG. 3 is an exploded top plan of a limb section including a support ring, two of the limb-forming tubes and associated connections;

FIG. 4 is a perspective view of a detail of the support ring of FIG. 3;

FIG. 5 is a perspective view of one of the connectors shown in FIG. 3;

FIG. 6 is a schematic top plan view of one of the limb sections of FIGS. 1 and 2;

DESCRIPTION OF THE PREFERRED EMBODIMENTS

Figure 1:
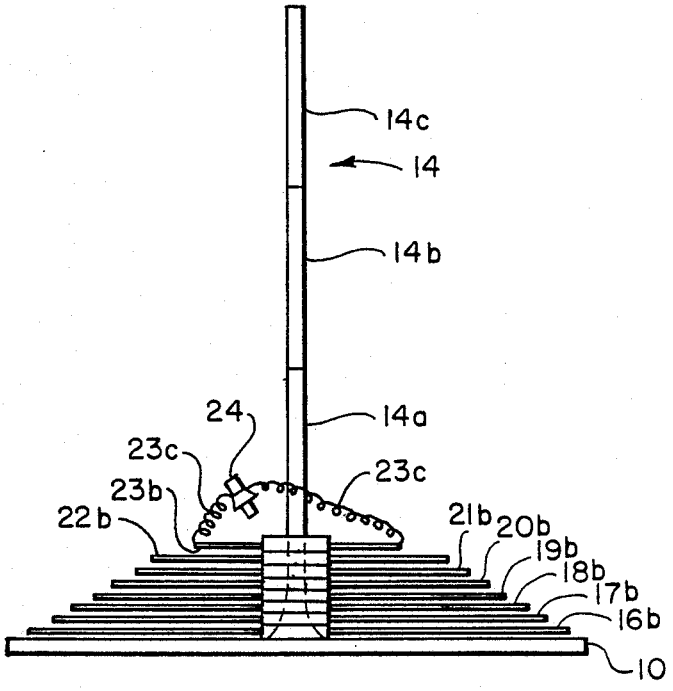
FIG. 1 is a schematic side elevational view of the assembly in accordance with a preferred embodiment of the invention, prior to erection thereof, with most of the interconnecting garlands omitted for purposes of clarity.
Figure 2:
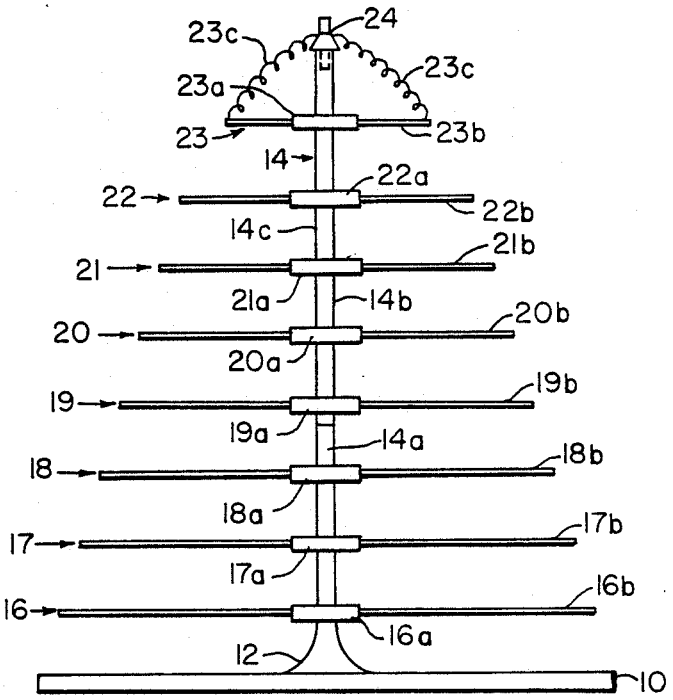
FIG. 2 is a side elevational view similar to that of FIG. 1, showing the tree as erected.

Referring to FIGS. 1 and 2, the basic components of the Christmas tree assembly of the invention are shown, apart from the interconnecting garlands which have been omitted for purposes of clarity. The components include a base 10 which is made from the bottom of the box or carton in which the other components of the assembly are stored and which is made, for example, of corrugated cardboard or the like. The base 10 includes an vertically extending, generally tubular support member or pole holder 12 which is affixed thereto are integral therewith. Pole holder 12 is adapted to receive a three-piece center pole 14. Pole 14, which preferably is made of plastic or the like, is formed by three individual pieces 14*a*, 14*b* and 14*c* that fit together to form the pole and can be broken down for storage in the box for the assembly.

The basic components further include a plurality of limb sections (eight in the specific embodiment under consideration) denoted 16, 17, 18, 19, 20, 21, 22 and 23. As described in more detail below, limb sections 16–23 include respective central branch support rings 16*a*–23*a* and a plurality of limb-forming tubes or rods 16*b*–23*b* which project radially outwardly from the associated rings 16*a*–23*a* (two of which tubes being shown for each ring in FIGS. 1 and 2).

The final basic component is a tip member 24 which fits in the top of pole 14 and which is attached to upper limb section 23 by associated garlands, two of which, denoted 23*c* are shown in FIGS. 1 and 2. As noted above, the other garlands are omitted in FIGS. 1 and 2 for purposes of clarity and as will be apparent, these garlands are a key element in erecting the tree. It should be understood that tip member 24 can take a number of forms and can, for example, comprise a ring which is adapted to engage the top of the pole 14.

The branch support rings 16*a*–23*a* are each preferably of the configuration shown in FIG. 3. Considering ring 16*a* as typical, this ring, as illustrated in FIG. 3, includes a central ring portion 30 and a plurality of radially projecting tube mounting members 32, with sixteen such members 32 being provided in the specific embodiment illustrated in FIG. 3. As illustrated in FIGS. 3 and 4, tube mounting members 32 include slots 32*a* adapted to receive the garlands referred to above therein. Mounting members 32 are shaped, preferably in the form of a cylinder, so as to receive one end of a corresponding limb forming tube 16*b* thereon. As illustrated (see also, FIG. 6), tubes 16*b* are of two lengths and comprise long tubes 34 and short tubes 36, both of which receive slotted connectors 38 in the opposite, tree ends thereof. As shown in FIG. 5, each connector 38 include slotted end portions 40 and 42, and a central cylindrical hub or stop portion 44 of larger diameter than the end portions 40 and 42 which abuts against the end of the corresponding tube 16*b*. Thus, referring to FIG. 3, and considering short tube 36, connector 38 is mounted in tube 36 so that end portion 40 is received therein and end portion 42 extends outwardly therefrom and thus is exposed so as to be able to receive a garland in the slot 42*a* found therein.

As illustrated in FIG. 6, the long rods 34 and short rods 36, which are collectively denoted 16*b*, are arranged in staggered relationship around the circumference of central ring portion 30 of ring member 16*a*.

Figure 7:
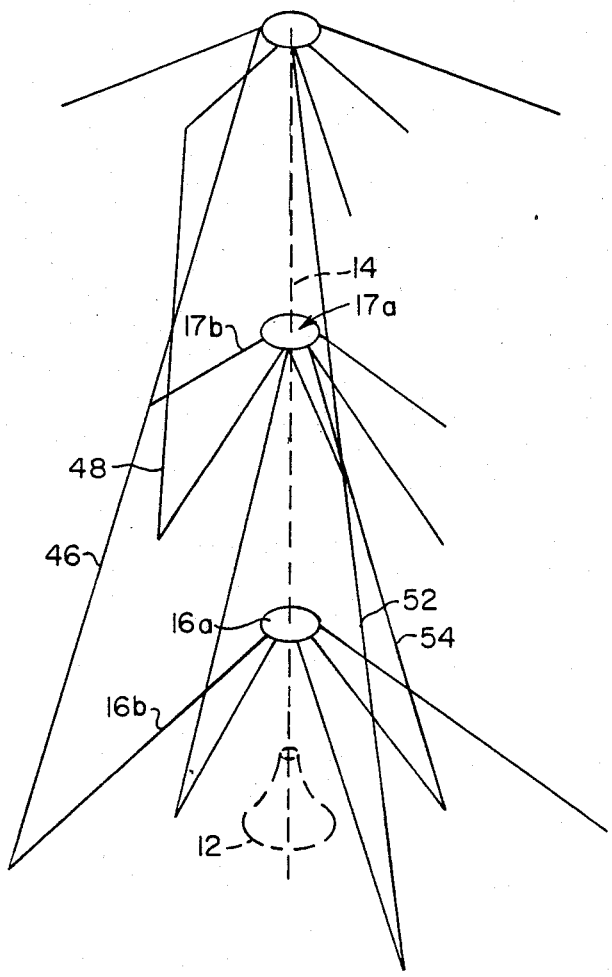
FIG. 7 is schematic perspective view of a portion of an erected tree, showing the interconnections between the limb sections at different levels.
Figure 8:
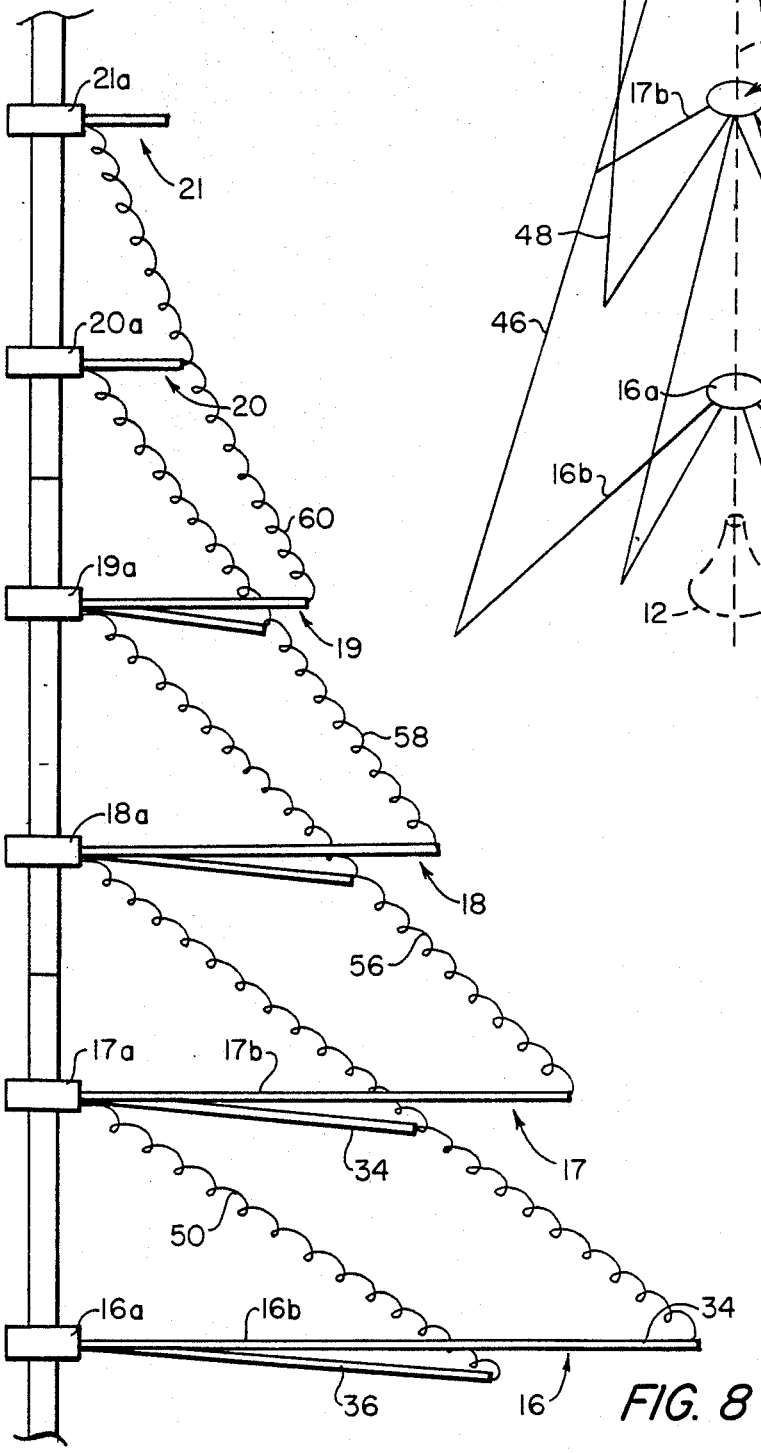
FIG. 8 is a schematic side elevational view, partially broken away, and slightly skewed for purposes of illustration, showing selected limb sections and the associated interconnecting garlands.

Referring to FIGS. 7 and 8, two partial views of the assembled tree are provided, both of which are simplified for purposes of illustration. FIG. 7 is a perspective view, wherein a selected grouping of five garland support lines or wires are indicated at 46, 48, 50, 52 and 54, with the garlands carried thereby being omitted for purposes of clarity and with the central support pole 14 and its support 12 being shown in dashed lines, FIG. 7 is a side elevational view which shows the limb sections on only one side and which is partially or slightly skewed for purposes of illustration. The garlands carried by the support lines are denoted 70 in FIG. 8, which, in addition to showing garland support wires or lines 50 and 52 (which are also shown in FIG. 7), shows further wires 56, 58 and 60. As shown in both FIGS. 7 and 8, the garland support wire 50 extends between the free end of a short tube 36 of tubes 16*b* to the base of the long tube 34 of the next group of support tubes 17*b*, i.e., to central ring 17*a* of the next limb section 17 (this is best seen in FIG. 7). Further, garland support line 52 extends from the free end of a long tube 34 of tubes 16*b* to the free end of a short tube 36 of the tubes 17*b* of the next level and from there to the base of a long tube 36 of tubes 18*b* of the next level, i.e., to ring 18*a*. Similarly, garland support line 46 extends from the end of a long tube 34 of tubes 16*b* to the end of a short tube 36 of tubes 17*b* to the base of a long tube 34 of tubes 18*b*.

As shown in FIG. 8, support wire 48 extends from the free end of a long tube 34 of tubes 17*b* to the free end of a short tube 36 of tubes 18*b* and on to the next support ring (this would be ring 19*a*, which is not shown in FIG. 7), while line 54 extends between a short tube 36 of tubes 16*b* to ring 17*a* at the base of a long tube 34 of tubes 17*b*.

Further, as shown in FIG. 8, garland support lines 56, 58 and 60 extend between the free end of a long tube 34 at a first level to the free end of a short tube 36 at the next higher level, and thence to the corresponding support ring at a next higher level.

It is important to note that, as can best be seen in FIG. 8, the lengths of the both the long and short tubes at the various levels are graduated in length from the bottom to the top so that the overall shape is that of a triangle, which is, of course, the basic shape of a pine or fir tree.

Considering the method of using the artificial tree of the invention, i.e., the method of erecting the tree, as stated above, the entire tree assembly comes in a box (not shown) and the bottom 10 of the box is first placed on the floor so as to serve as the base of the tree. The pole 14 is assembled from pole parts 14*a*, 14*b* and 14*c* and is placed in center support tube or holder 12 secured to the box bottom 10. As shown in FIG. 1, the limb sections 16–23 are initially stacked in place on the center support tube 12 and thus, by lifting the tree tip 24 up the pole 14, the uppermost garlands 23*c* (FIGS. 1 and 2) between the tip 24 and ring 23*a* will become taut or tensioned and the other garlands 70 between the various limb sections 16–23 will also become tensioned, in turn, thereby lifting each limb section to support the next as the tip 24 is lifted to top of the tree. Tip 24, after having been lifted to top of pole 14, is inserted into to an aperture therein or otherwise secured thereto, so that the tree is then fully erected and ready to decorate.

To return the tree to the "down" position for storage, the tip 24 is lifted up clear of the end of the pole 14 and the limb assembly formed by limb sections 16–23 is simply allowed to drop. All of the limb sections 16–23 will simply slide down the pole 14 into the down, collapsed positions thereof. By simply breaking down the pole 14 and placing the ports **14*a*–14*c* onto the box bottom 12**, and placing the cover (not shown) on the box, the tree assembly can be stored for next use.

The garlands 70 can be made from 4,6 or higher ply garlands and many different colors are available. Garlands including lights already incorporated therein can also be used.

As noted above, the tip member 24 can take other forms and can, for example, comprise an uppermost ring, similar to the other rings, which is adapted to engage the tip of the pole 14.

It should also be noted that tip 24 can be suspended from a hook, hanger or the like (i.e., tree limb, porch eaves, etc.) and does not have to be supported from the top of pole 14. Further, the tree can be made as one-half of a full circumference to fit against a wall or as one-quarter of a full circumference to fit in a corner.

Although the present invention has been described relative to exemplary embodiments thereof, it will be understood by those skilled in the art that variations and modifications can be effected in these exemplary embodiments without departing from the scope and spirit of the invention.

I claim:

1. An artificial tree assembly comprising:

a collapsible pole;

a base member formed by the bottom of a box for storing the tree assembly and including a pole support member secured thereto for supporting the pole;

a plurality of limb sections, each said limb section comprising a central ring portion and a plurality of limb members extending radially outwardly from said central ring portion, the ring portions of the limb sections being stacked, when not in use, on said pole support member and being disposed, in use, along the length of the pole in spaced relationship therealong and;

a plurality of garlands interconnecting said limb portions so that as the ring portions are lifted from the top from the stacked position thereof on the pole support member and slid along the pole, the garlands between adjacent limb section are tensioned in turn and thereby serve to lift the next adjacent limb section in sequence until all of the rings assume said spaced relationship along the pole, whereby the tree is erected.

2. An artificial tree assembly as claimed in claim 1 wherein said collapsible pole comprises a plurality of separate pole parts which can be fit together to form the pole.

3. An artificial tree assembly as claimed in claim 1 wherein said support member includes a tubular end portion in which the pole is received.

4. An artificial tree assembly as claimed in claim 1 wherein said limb members are of different lengths.

5. An artificial tree assembly as claimed in claim 4 wherein limb members of different limb sections are of different lengths, the lengths of the limb members becoming gradually shorter as a function of the spacing of the limb sections from the base member.

6. An artificial tree assembly as claimed in claim 5 wherein the limb members of the same limb section are of two different lengths.

7. An artificial tree assembly as claimed in claim 4 wherein the limb members of the same limb section are of two different lengths.

8. An artificial tree assembly as claimed in claim 1 wherein at least some of said garlands extend between and interconnect three different limb sections.

9. An artificial tree assembly as claimed in claim 1 wherein said ring portions each comprise a ring including a plurality of slotted projections in which associated garlands are received, and said limb members comprise elongate tubes received at one end on said projections.

10. An artificial tree assembly as claimed in claim 9 wherein said limb members further comprises slotted connectors which are received in the other ends of said tubes and in which associated garlands are received.

11. An artificial fir tree construction comprising:

a base;

a central pole;

a pole support member secured to said base for supporting said pole;

a plurality of limb sections spaced along the length of said pole, each said limb section comprising a central ring and a plurality of radially projecting limb members extending radially outwardly from said central ring; and support means, comprising a plurality of decorative garland connecting members interconnecting adjacent limb sections, for suspending the limb sections from the top of the central pole in spaced relationship therealong.

12. An artificial fir tree construction as claimed in claim 11 wherein said pole comprises a collapsible pole including a plurality of separate pole parts which can be fit together to form the pole.

13. An artificial fir tree construction as claimed in claim 11 wherein said pole support member includes a tubular end portion in which the pole is received.

14. An artificial fir tree construction as claimed in claim 11 wherein said limb members are of different lengths.

15. An artificial fir tree construction as claimed in claim 14 wherein limb members of different limb sections are of different lengths, the lengths of the limb members becoming gradually shorter as a function of the spacing of the limb sections from the base member.

16. An artificial fir tree construction as claimed in claim 15 wherein the limb members of the same limb section are of two different lengths.

17. An artificial fir tree construction as claimed in claim 14 wherein the limb members of the same limb section are of two different lengths.

18. An artificial fir tree construction as claimed in claim 11 wherein at least some of the said garlands extend between and interconnect three different limb sections.

19. An artificial fir tree construction as claimed in claim 11 wherein said ring portions each comprise a ring including a plurality of slotted projections in which associated garlands are received, and said limb members comprise elongate tubes received at one end on said projections.

20. An artificial fir tree construction as claimed in claim 19 wherein said limb members further comprises slotted connectors which are received in the other ends of said tubes and in which associated garlands are received.

* * * * *